US008342806B1

(12) United States Patent
Stabe, Jr.

(10) Patent No.: US 8,342,806 B1
(45) Date of Patent: Jan. 1, 2013

(54) PADDLE FAN COVER

(76) Inventor: Robert H. Stabe, Jr., Vero Beach, FL (US)

( * ) Notice: Subject to any disclaimer, the term of this patent is extended or adjusted under 35 U.S.C. 154(b) by 757 days.

(21) Appl. No.: 12/574,228

(22) Filed: Oct. 6, 2009

(51) Int. Cl.
*F01D 25/00* (2006.01)

(52) U.S. Cl. ..... 416/146 R; 416/5; 150/165

(58) Field of Classification Search ..... 416/5, 62, 416/146 R, 210 R; 150/165
See application file for complete search history.

(56) References Cited

U.S. PATENT DOCUMENTS

| | | | | |
|---|---|---|---|---|
| 5,516,264 | A | 5/1996 | Anetrini | |
| 5,582,115 | A * | 12/1996 | Muller | 108/90 |
| 5,591,006 | A | 1/1997 | DeMeo et al. | |
| 5,868,189 | A * | 2/1999 | Jarvis | 150/165 |
| 5,947,686 | A | 9/1999 | Keyes | |
| 6,619,920 | B1 | 9/2003 | Cannon | |
| 8,100,652 | B2 * | 1/2012 | Bauer et al. | 416/62 |
| 2003/0031563 | A1 | 2/2003 | White | |
| 2005/0145516 | A1 * | 7/2005 | Severa et al. | 206/315.1 |
| 2007/0212222 | A1 | 9/2007 | White-Burnett | |

* cited by examiner

*Primary Examiner* — Ninh H Nguyen
*Assistant Examiner* — William Grigos
(74) *Attorney, Agent, or Firm* — Montgomery Patent & Design LLC; Robert C. Montgomery

(57) ABSTRACT

A vinyl cover for a ceiling fan to aid in keeping them clean and free from dust, particularly during non-use, is herein disclosed. The cover comprises a large, circular vinyl cover with a slightly larger diameter than that of the ceiling fan blades, further bifurcated into a two (2)-piece "pancake"-style design with a small diameter aperture in the center to accommodate a support pole for the ceiling fan. An upper piece is provided with a zipper that runs from the aperture to the outer perimeter. This zipper is opened to slide the cover over the ceiling fan blades and motor and then shut. In such a manner the ceiling fan assembly is kept clean and free from dust build-up when not in use. When needed again, it is simply opened, removed, and folded away for storage, leaving the ceiling fan clean and ready to operate.

17 Claims, 5 Drawing Sheets

PADDLE FAN COVER

RELATED APPLICATIONS

The present invention was first described in a notarized Official Record of Invention on Apr. 7, 2008, that is on file at the offices of Montgomery Patent and Design, LLC, the entire disclosures of which are incorporated herein by reference.

FIELD OF THE INVENTION

The present invention relates generally to ceiling fan accessories, and more particularly, to a removable cover for a ceiling fan which maintains clean and dust free fan paddles.

BACKGROUND OF THE INVENTION

Ceiling fans are commonly used to improve airflow in homes and businesses. They work by more evenly distributing air layers near the ceiling that may be warmer or cooler than the layers where people are located. In doing so, they help to reduce energy bills and provide a more comfortable living environment. However, in the transitional seasons between extremely cold and extremely hot weather, such fans sit in an inactive state. As such, the blades and motor assemblies tend to accumulate dust and dirt. Thus, when operation is needed again, the user must spend time cleaning the fan assembly. Even then, a great deal of dust can enter the motor which cannot be removed and may cause premature failure of the fan motor.

Various types of removable fan blade covers have attempted to overcome these disadvantages. These attempts can be seen by example in several U.S. Patents, including: U.S. Pat. No. 5,516,264, issued in the name of Anetrini, which describes a ceiling fan blade slip cover; U.S. Pat. No. 5,591,006, issued in the name of DeMeo et al., which describes a decorative cover for ceiling fan blade; U.S. Pat. No. 5,947,686, issued in the name of Keyes, which describes fan blade covers; and U.S. Pat. No. 6,619,920, issued in the name of Cannon, which describes an adjustable ceiling fan blade cover.

While these attempts may fulfill their respective, particular objectives, each of these examples suffer from various disadvantages, including limitation to only covering the individual fan blades. Accordingly, there exists a need for a means by which ceiling fans can be protected from dust and dirt during extended periods of non-use. The development of the present invention substantially departs from the conventional solutions and in doing so fulfills this need.

SUMMARY OF THE INVENTION

In view of the foregoing references, the inventor recognized the aforementioned inherent problems and observed that there is a need for a cover for a ceiling fan which protects both the fan blades and the motor and thus, the object of the present invention is to solve the aforementioned disadvantages and provide for this need.

Another object of the present invention is to provide a fan cover having a circular configuration which is durable and simple to apply and remove from a conventional ceiling fan.

Another object of the present invention is to provide a fan cover which can be utilized with various sizes and model of ceiling fans.

Another object of the present invention is to provide a fan cover which protects ceiling fan blades and motor from dust and dirt accumulation during periods of non-use.

Another object of the present invention is to provide a fan cover which prevents ceiling fan damage, saves time and effort cleaning the fan, and makes the initial seasonal operation of the fan simple.

Another object of the present invention is to provide a fan blade cover which is easily folded for storage.

To achieve the above objectives, the present invention provide a device for protecting a motor and fan blades of a paddle type ceiling fan from dust and grime accumulation as well as from moisture damage during prolonged idle times, generally comprising an upper member and a lower member coupled which are coupled together. The upper and lower members are specially adapted to cover the motor and the fan blades having a peripheral seam formed along outer peripheral edges, such that the upper and lower members define a bifurcating configuration. Upper and lower central apertures located at a center position of the upper and lower members are adapted to receive an existing suspension rod of the paddle type ceiling fan. Upper and lower slits extend radially from the central apertures and terminate at the peripheral seam.

The upper member generally comprises a linear fixed edge extending along an entire longitudinal length of the upper slit and a flap which is affixed to an entire longitudinal length of the fixed edge. A linear closing edge extends along an entire longitudinal length of the upper slit such that the flap is removably attached to the closing edge of the upper member and t completely covers the upper slit.

The lower member generally comprises a linear fixed edge extending along an entire longitudinal length of the lower slit and a flap which is affixed to an entire longitudinal length of the fixed edge. A linear closing edge extends along an entire longitudinal length of the lower slit such that the flap is attached to the closing edge of the lower member and completely covers the lower slit.

The device further comprises a desiccant pocket which is permanently affixed to an inner surface of the upper member and a moisture-absorbing material within the pocket which maintains the fan motor in a dry condition.

Yet still another object of the present invention is to provide a method of utilizing the fan blade cover that enables a user to keep a ceiling fan clean during periods of extended non-use in a manner which is quick, easy and effective.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | fan cover |
| 11 | upper member |
| 12 | lower member |
| 13 | peripheral seam |
| 14 | upper slit |
| 15 | upper slit cover flap fixed edge |
| 16 | upper slit cover flap closing edge |
| 17 | lower slit |
| 18 | lower slit cover flap fixed edge |
| 19 | lower slit cover flap closing edge |
| 23 | lower member flap |
| 25 | upper member flap |
| 32 | lower member aperture |
| 36 | desiccant pocket |
| 40 | motor cover enclosure |
| 60 | fan assembly |
| 61 | fan blade |
| 62 | fan motor |
| 63 | suspension cover |
| 64 | suspension rod |
| 65 | ceiling |
| 66 | motor cover |
| 70 | alternate light fixture embodiment |
| 71 | light fixture globe |
| 72 | light fixture holder |
| 80 | alternate low ceiling embodiment |

DETAILED DESCRIPTION OF THE PREFERRED EMBODIMENT

Figure 3:
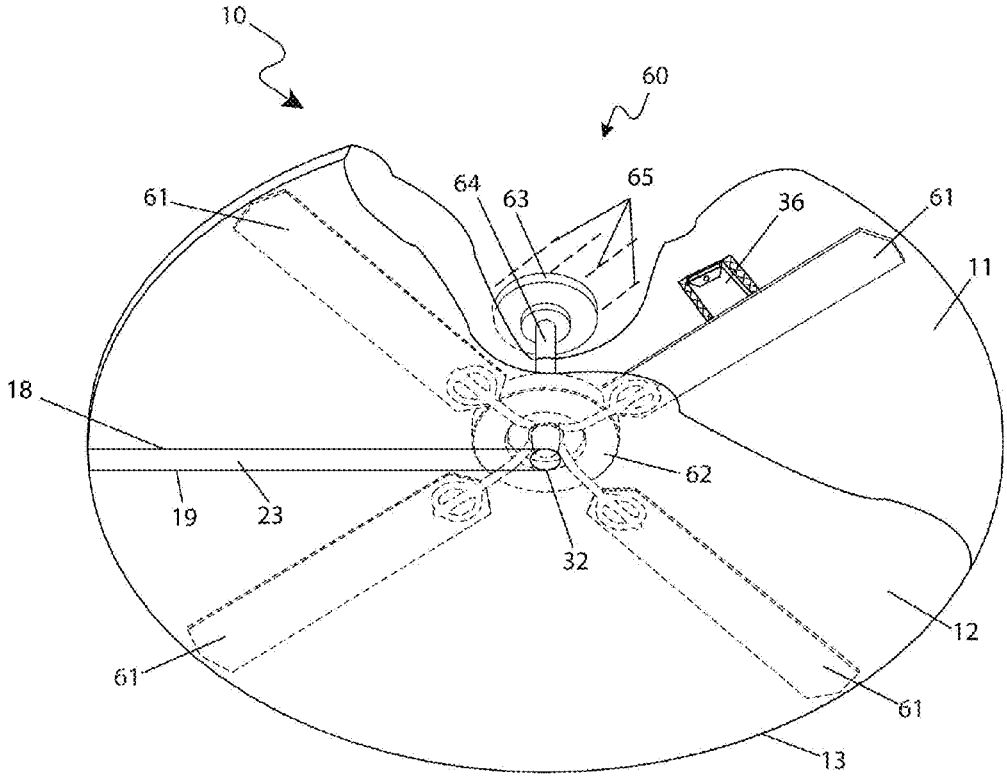
FIG. 3 is a perspective view of the ceiling fan cover 10, with a cut-away portion of the upper member 11 and of the lower member 12, according to a preferred embodiment of the present invention.
Figure 4:
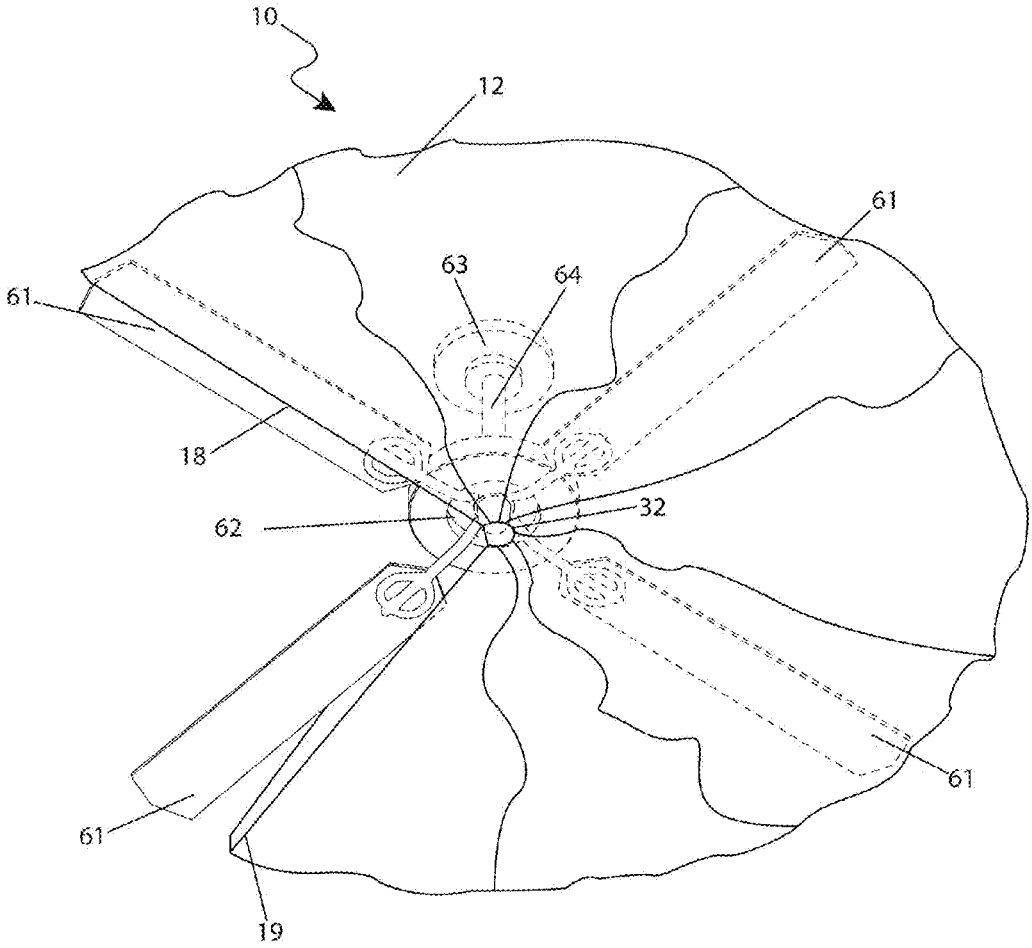
FIG. 4 is a perspective view of the ceiling fan cover 10 depicting a partially installed state, according to a preferred embodiment of the present invention.
Figure 5:
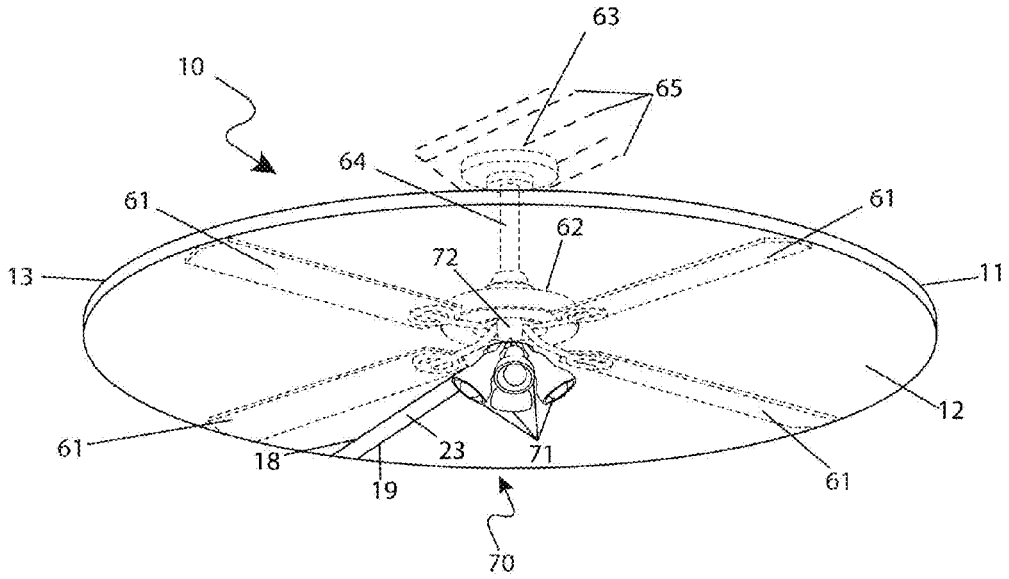
FIG. 5 is a perspective view of an alternate embodiment 60 of the present invention depicting the application thereto a stationary light fixture 70, according to an alternate embodiment of the present invention; and, FIG. 6 is a perspective view of another alternate embodiment of the present invention, depicting an aperture 40 in an upper member 11 enclosed therearound a low ceiling motor cover 66, according to an alternate embodiment of the present invention.
Figure 6:
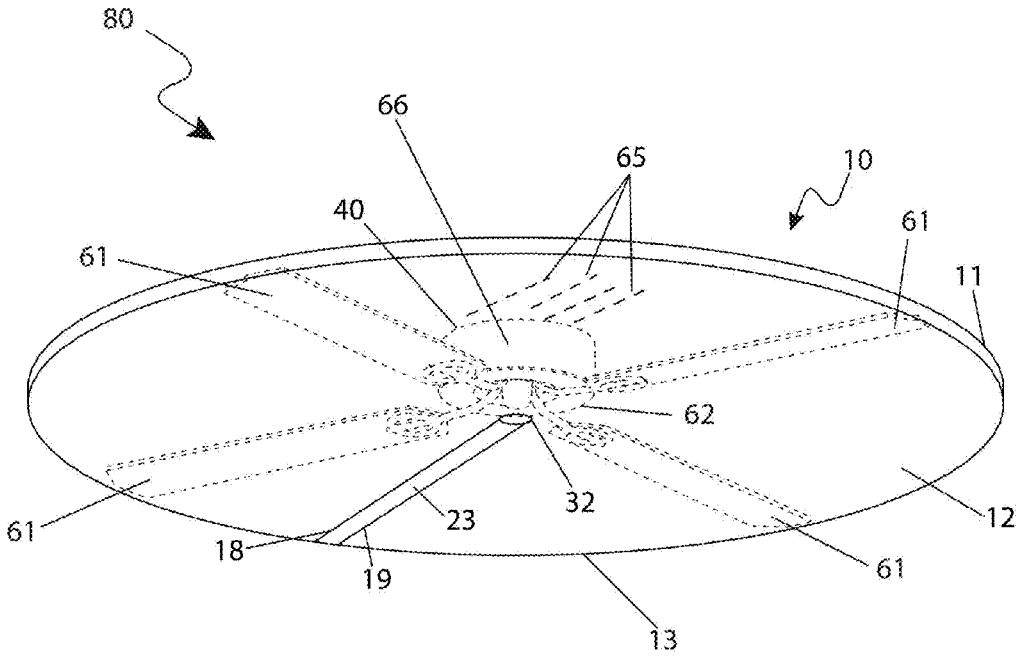

The best mode for carrying out the invention is presented in terms of its preferred embodiment, herein depicted within FIGS. 1 through 4 and in terms of alternate embodiments depicted in FIGS. 5 and 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a fan blade cover (herein described as the "device") 10, which provides a means for protecting the blades 61 and motor 62 of paddle type ceiling fans 60 from the accumulation of dust and grime and from possible moisture damage during prolonged idle times, such as off-season periods.

Figure 2:
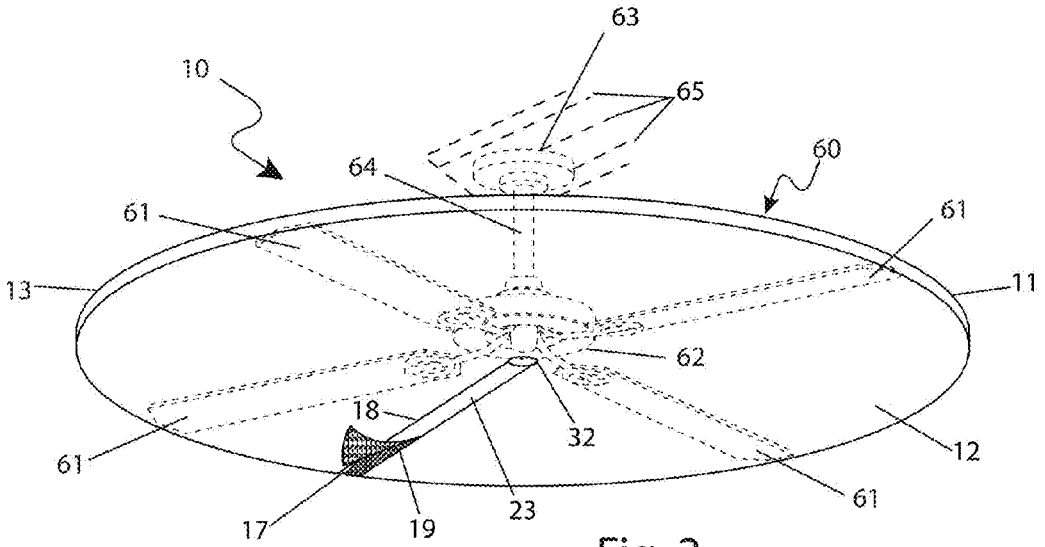
FIG. 2 is a bottom perspective view of the ceiling fan cover 10, according to a preferred embodiment of the present invention.
Figure 1:
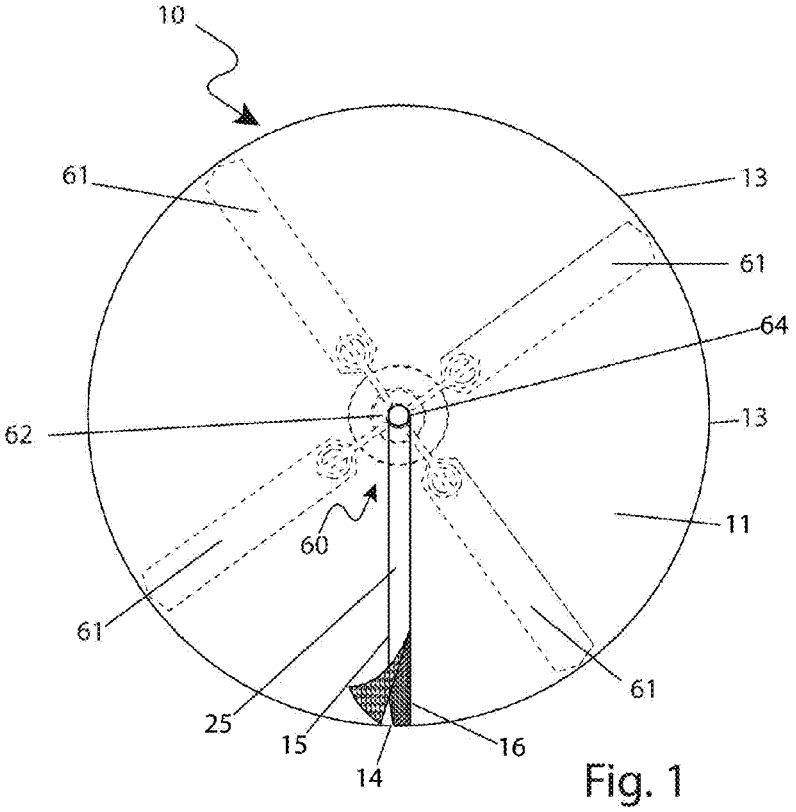
FIG. 1 is a top view of a ceiling fan cover 10, according to a preferred embodiment of the present invention.

Referring now to FIGS. 1 and 2, a top plan view and a bottom perspective view of the device 10 according to the preferred embodiment of the present invention, are disclosed. The device 10 comprises two (2) membrane-like members, an upper member 11 and a lower member 12, wherein said members are envisioned to be made of a limber, soft and flexible fabric, plastic or plastic backed type of material permanently conjoined by means of a strong peripheral seam 13. The choice of specific material used in the manufacture of said members dictates the choice of process used for producing the subject seam 13, which may include, but not be limited to, sewing, gluing, or heat sealing, applied individually or in combination, along with provisions for appropriate reinforcement.

Referring now to FIG. 3, a perspective view looking up at the underside of the device 10, according to the preferred embodiment 60 of the present invention, is disclosed. The device 10 is illustrated here showing a portion of the upper member 11 and the lower member 12 cut away in order to better illustrate a bifurcating configuration produced by a peripheral joining of the upper member 11 and lower member 12, and showing how the device 10 is closed around a suspension rod 64. FIG. 3 also illustrates a lower slit 17, running radially therefrom a center aperture and extending therefrom through the peripheral seam 13. A corresponding upper slit 14 is located thereat the upper member 11, and configured in a similar manner to the lower slit 17. The upper slit 14 and lower slit 17 each enable the device 10 to be readily opened in order to permit installing the device 10 over the fan blades 61 and the fan motor 22. Subsequent to the installation, the device 10 is closed around the complete fan assembly 60. The upper slit 14 is preferably sealed by an upper member flap 25, affixed at an upper slit cover flap fixed edge 15 and the lower slit 17 is preferably sealed by a lower member flap 23 affixed at a lower slit cover flap fixed edge 18. Both the upper member flap 25 and lower member flap 23 provide access thereto the upper slit 14 and lower slit 17, respectively, by various closing elements, such as, but not limited to, flaps (represented in FIG. 3 as 23 and 25), hook-and-loop strips, zippers or ZIPLOCK™-type closures. The upper member flap 25 removably attaches to the upper member 11 via an upper slit cover closing edge 16 to cover the upper slit 14, and the lower member flap 23 removably attached to lower member 12 via a lower slit cover edge 19 to cover the lower slit 17. Such elements, as well as draw strings, may also be used to allow a tight closure around the suspension rod 64. A desiccant pocket 36, permanently affixed to the inner surface of upper member 11 is intended to receive a state of art commercially available packet (not shown) of moisture absorbing material for the purpose of keeping the fan motor 62 in a dry condition.

Referring now to FIG. 4, a perspective view of the device 10, according to the preferred embodiment of the present invention 10 is disclosed. The device 10 is illustrated here depicting a partially installed state, wherein the device is spread along the upper slit 14 and lower slit 17, thereby providing a means for making the installation possible.

Referring now to FIG. 5, a perspective view of an alternate embodiment of the present invention 70 is disclosed. The device 10 is used to cover and totally enclose the entire fan assembly 60, while leaving an integrated fixed light fixture that is rigidly mounted to an underside of a fan motor 62, and exposed in an available operational condition. A light fixture housing enclosure provides a tight enclosure around a light fixture globe 71 and a light fixture holder 72.

Referring now to FIG. 6 a perspective view of another alternate embodiment 80 of the present invention is herein disclosed. The device 10 is used to cover and totally enclose a fan assembly 60, wherein a decorative fan motor cover 66 replaces the suspension rod 64 in order to accommodate a low overhead condition which necessitates mounting the fan assembly 60 in closer proximity to the ceiling 65 than allowed by the use of a suspension rod 64. Within this embodiment 80, the upper member 11 of the device is sealed around said motor cover 66. A motor cover enclosure 40 provides a tight enclosure around the motor cover 66.

It is envisioned that other styles and configurations of the present invention can be easily incorporated into the teachings of the present invention. Only one particular configuration is shown and described herein, for purposes of clarity and disclosure and not by way of limitation of scope.

Among a variety of envisioned modifications is the application of an infinite variety decorative patterns on the upper member 11 and lower member 12 of the device 10, such as, but not limited to: flowers, miscellaneous scenery, historic places, clouds, sky, sun and snow, rainbows, different colors, or logos that provide an aesthetic and attractive means therefor the device 10, based on user preference.

The method of installing the device 10 is achieved by performing the following steps: removing the device 10 from packaging or storage; inserting the desiccant material into the designated pocket 36; securing oneself firmly on a stepladder; unfastening the lower member flap 23 from the lower slit cover flap closing edge 19, thereby exposing the lower slit 17; unfastening the upper member flap 25 from the upper slit cover flap closing edge 16, thereby exposing the upper slit 14; spreading the device 10 into the open state to allow it to be slipped over appropriate fan assembly embodiment 60; gently engaging the device 10 over a first fan blade 61; gently slipping the device 10 over the remaining fan blades 61 and the fan motor 62; closing the device 10 to completely encircle and cover the blades 61 and the fan motor 62; closing the upper member 11 and securing the upper member flap 25; closing the lower member 12 and securing the lower member flap 23; closing the upper member 11 around a suspension rod 64; and, performing foregoing steps in reverse order when uninstalling device 10 from a fan assembly 60.

The method of installing the device 10 onto the alternate light fixture embodiment 70 is achieved by performing the following step in addition to the steps described above: using a lower member aperture 32 in the lower member 12 to encircle the light fixture holder 72.

The method of installing the device 10 onto the alternate low ceiling embodiment 80 is achieved by performing the following the same steps as described above: securing the motor cover enclosure 40 around a decorative motor cover 66.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A fan blade cover for protecting a motor and fan blades of a paddle type ceiling fan from dust and grime accumulation as well as from moisture damage during prolonged idle times, said fan blade cover comprising:

an upper member and a lower member coupled thereto, said upper and lower members being adapted to cover the motor and the fan blades respectively;

a peripheral seam formed along respective outer peripheral edges of said upper and lower members such that said upper and lower members define a bifurcating configuration;

upper and lower central apertures formed at a center of said upper and lower members respectively, said upper and lower central apertures being adapted to receive an existing suspension rod of the paddle type ceiling fan; and, upper and lower slits respectively extending radially from said central apertures of said upper and lower members and terminating at said peripheral seam respectively.

2. The fan blade cover of claim 1, wherein said upper member comprises:

a linear fixed edge extending along an entire longitudinal length of said upper slit;

a flap affixed to an entire longitudinal length of said fixed edge;

a linear closing edge extending along an entire longitudinal length of said upper slit;

wherein said flap of said upper member is removably attached to said closing edge of said upper member and thereby completely covers said upper slit.

3. The fan blade cover of claim 1, wherein said lower member comprises:

a linear fixed edge extending along an entire longitudinal length of said lower slit;

a flap affixed to an entire longitudinal length of said fixed edge;

a linear closing edge extending along an entire longitudinal length of said lower slit;

wherein said flap of said lower member is removably attached to said closing edge of said lower member and thereby completely covers said lower slit.

4. The fan blade cover of claim 1, further comprising:

a desiccant pocket permanently affixed to an inner surface of upper member; and, a moisture-absorbing material housed within said pocket for maintaining the fan motor in a dry condition.

5. The fan blade cover of claim 2, wherein said fixed and closing edges of said upper member are linear.

6. The fan blade cover of claim 3, wherein said fixed and closing edges of said lower member are linear.

7. A fan blade cover for protecting a motor and fan blades of a paddle type ceiling fan from dust and grime accumulation as well as from moisture damage during prolonged idle times, said fan blade cover comprising:

an upper member and a lower member coupled thereto, said upper and lower members being adapted to cover the motor and the fan blades respectively;

a peripheral seam formed along respective outer peripheral edges of said upper and lower members such that said upper and lower members define a bifurcating configuration;

upper and lower central apertures formed at a center of said upper and lower members respectively, said upper and lower central apertures being adapted to receive an existing suspension rod of the paddle type ceiling fan; and, upper and lower slits respectively extending radially from said central apertures of said upper and lower members and terminating at said peripheral seam respectively;

wherein said upper slit is axially aligned above said lower slit.

8. The fan blade cover of claim 7, wherein said upper member comprises:

a fixed edge extending along an entire longitudinal length of said upper slit;

a flap affixed to an entire longitudinal length of said fixed edge; and, a closing edge extending along an entire longitudinal length of said upper slit;

wherein said flap of said upper member is removably attached to said closing edge of said upper member and thereby completely covers said upper slit.

9. The fan blade cover of claim 7, wherein said lower member comprises:

a fixed edge extending along an entire longitudinal length of said lower slit;

a flap affixed to an entire longitudinal length of said fixed edge; and, a closing edge extending along an entire longitudinal length of said lower slit;

wherein said flap of said lower member is removably attached to said closing edge of said lower member and thereby completely covers said lower slit.

10. The fan blade cover of claim 7, further comprising:

a desiccant pocket permanently affixed to an inner surface of upper member; and, a moisture-absorbing material housed within said pocket for maintaining the fan motor in a dry condition.

11. The fan blade cover of claim 8, wherein said fixed and closing edges of said upper member are linear.

12. The fan blade cover of claim 9, wherein said fixed and closing edges of said lower member are linear.

13. A method for protecting a motor and fan blades of a paddle type ceiling fan from dust and grime accumulation as well as from moisture damage during prolonged idle times, said method comprising the steps of:

a. providing a blade cover including an upper member and a lower member coupled thereto, a peripheral seam formed along respective outer peripheral edges of said upper and lower members such that said upper and lower members define a bifurcating configuration, upper and lower central apertures formed at a center of said upper and lower members respectively, upper and lower slits respectively extending radially from said central apertures of said upper and lower members and terminating at said peripheral seam respectively, and a desiccant pocket permanently affixed to an inner surface of upper member, wherein said upper slit is axially aligned above said lower slit;

b. providing and housing a moisture-absorbing material within said pocket;

c. positioning said upper and lower members over the motor and the fan blades respectively; and, d. receiving an existing suspension rod of the paddle type ceiling fan through said upper and lower central apertures.

14. The method of claim 13, wherein step c. comprises the steps of:

exposing the lower slit by unfastening a lower member flap from a closing edge of said lower member;

exposing said upper slit by unfastening an upper member flap from a closing edge of said upper member;

slipping said upper and lower members over each fan blade of the paddle type ceiling fan by spreading said upper and lower members into an open state; and, slipping said upper and lower members over the motor of the paddle type ceiling fan.

15. The method of claim 14, wherein step c. further comprises the steps of:

closing said upper member by securing said upper member flap to said upper member closed edge; and, closing said lower member by securing said lower member flap to said lower member closed edge.

16. The method of claim 15, wherein step d. comprises the step of: encircling said lower member central aperture about a light fixture holder of the existing paddle type ceiling fan.

17. The method of claim 16, further comprising the step of: providing and securing a motor cover enclosure around a motor cover of the existing paddle type ceiling fan.

* * * * *